US010178916B2

(12) United States Patent
Villei

(10) Patent No.: US 10,178,916 B2
(45) Date of Patent: Jan. 15, 2019

(54) CHANGING MAT RESTRAINT SYSTEM

(71) Applicant: Happy Monkey Baby Company, LLC, Las Vegas, NV (US)

(72) Inventor: Deana Villei, Las Vegas, NV (US)

(73) Assignee: HAPPY MONKEY BABY COMPANY, LLC, Las Vegas, NV (US)

( * ) Notice: Subject to any disclaimer, the term of this patent is extended or adjusted under 35 U.S.C. 154(b) by 0 days.

(21) Appl. No.: 15/713,355

(22) Filed: Sep. 22, 2017

(65) Prior Publication Data

US 2018/0078050 A1 Mar. 22, 2018

Related U.S. Application Data

(60) Provisional application No. 62/398,388, filed on Sep. 22, 2016.

(51) Int. Cl.
*A47D 5/00* (2006.01)
*A47D 15/00* (2006.01)

(52) U.S. Cl.
CPC ..... *A47D 5/006* (2013.01); *A47D 15/005* (2013.01)

(58) Field of Classification Search
CPC ..... A47D 5/00
USPC ..... 5/655, 632, 652
See application file for complete search history.

(56) References Cited

U.S. PATENT DOCUMENTS

| | | | | |
|---|---|---|---|---|
| 2,102,281 | A | 12/1937 | Pringle | |
| 2,758,595 | A | 8/1956 | Lovett | |
| D393,561 | S | 4/1998 | Hayes | |
| 6,009,874 | A | 1/2000 | Sartin et al. | |
| 6,755,198 | B2 | 6/2004 | Parker | |
| 7,065,814 | B2 | 6/2006 | Rutkowski | |
| D743,186 | S | 11/2015 | Perdue | |
| 2006/0108855 | A1 | 5/2006 | Watson | |
| 2011/0209716 | A1 | 9/2011 | Scarsbrook | |
| 2011/0265265 | A1 | 11/2011 | Roach | |
| 2012/0159708 | A1 | 6/2012 | Malet | |
| 2014/0082848 | A1* | 3/2014 | Fort | A47D 15/008 5/655 |
| 2014/0090175 | A1* | 4/2014 | Thrailkill | A47D 15/008 5/655 |
| 2015/0359355 | A1* | 12/2015 | Rushing | A47D 5/00 5/655 |

* cited by examiner

*Primary Examiner* — Fredrick C Conley
(74) *Attorney, Agent, or Firm* — Kunzler, PC

(57) ABSTRACT

Embodiments of an apparatus are disclosed. The apparatus includes a changing mat, a mat-native restraint system, and a pass-through structure. The mat-native restraint system is coupled to the changing mat at a location on the changing mat to receive and secure a user on the changing mat. The pass-through structure is disposed in the changing mat to accommodate pass-through, at the changing mat, of at least a portion of a mat-foreign restraint system to secure the changing mat to a changing surface and to further secure the user on the changing mat.

20 Claims, 10 Drawing Sheets

CHANGING MAT RESTRAINT SYSTEM

CROSS-REFERENCES TO RELATED APPLICATIONS

This application claims the benefit of U.S. Provisional Patent Application No. 62/398,388 entitled "CHANGING MAT RESTRAINT SYSTEM" and filed on 22 Sep. 2017 for Deana Villei, which is incorporated herein by reference.

FIELD

This invention relates to a changing mat and more particularly relates to a changing mat with a native restraint system which is compatible with a conventional changing surface having its own restraint system.

BACKGROUND

When caring for a child or other user (such as a patient or other care recipient), it is frequently necessary to change a diaper, bandage, clothing, feeding tube, colostomy bag, etc. Changing pads are useful to keep soil, soiled garments, and diapers off a surface but all so to protect the person from any contaminants that may be found on the surface on which the person would be placed. Frequently, a changing surface, table, etc. is available which is intended for the changing of a diaper, bandage, colostomy bag, etc. Some examples may include a public restroom changing table, a home changing table, a table in a hospital, nursing home, etc. Nevertheless, these surfaces may not be ideal. In the example of a public restroom changing table, the surface of the changing table may be unsanitary due to lack of cleaning, frequency of public use, or other factors such as a broken restraint system. In the case of the home changing table, it may be desirable to prevent soiling of the changing table pad or the table itself. In either example, it may be beneficial to place a changing mat on the changing surface to protect the person and/or the surface during the process of using the surface. However, conventional changing mats do not secure the person to the changing surface as they block or render useless the restraint system built into the changing surface. Additionally, conventional changing mats may allow the person to roll from the changing surface. These and other aspects of conventional changing mats do not provide a satisfactory solution for changing a diaper, bandage, feeding tube, etc. of a person.

SUMMARY

An apparatus is disclosed. The apparatus includes a changing mat, a mat-native restraint system, and a pass-through structure. The mat-native restraint system is coupled to the changing mat at a location on the changing mat to receive and secure a user on the changing mat. The pass-through structure is disposed in the changing mat to accommodate pass-through, at the changing mat, of at least a portion of a mat-foreign restraint system to secure the changing mat to a changing surface and to further secure the user on the changing mat.

In some embodiments, the mat-native restraint system includes at least one strap to secure at least one of a chest and shoulders of the user on the changing mat. In some embodiments, the at least one strap includes at least one pad disposed on the at least one strap. In some embodiments, the mat-native restraint system includes a buckle separately coupled to at least a first point and a second point of the at least one strap. Connecting the first point and the second point via the buckle secures the user to the changing mat.

In some embodiments, the buckle is divided into at least four interconnecting buckle sections. The sections include a first buckle section coupled to a first shoulder portion of the at least one strap, a second buckle section coupled to a second shoulder portion of the at least one strap, a third buckle section coupled to a first ribcage portion of the at least one strap, and a fourth buckle section coupled to a second ribcage portion of the at least one strap.

In some embodiments, the buckle includes an attachment structure to interface with the mat-foreign restraint system. In some embodiments, the buckle includes at least one of a clip, a snap, a hook-and-loop, a cinch, and a tie. In some embodiments, a shield is positioned between the buckle and the user. In some embodiments, the pass-through structure includes at least one slot in the changing mat to allow at least a portion of the mat-foreign restraint system to pass through the changing mat.

In some embodiments, the mat-foreign restraint system includes at least one strap coupled to the changing surface. In some embodiments, the changing surface is a changing surface of a fixed location changing table. In some embodiments, the changing mat includes a stiffened portion to resist a bending of the changing mat in at least one dimension. In some embodiments, the changing mat includes at least one tab on an edge of the changing mat to secure the edge of the changing mat relative to the changing surface. In some embodiments, the changing mat is at least one of foldable, collapsible, rollable, and stuffable. In some embodiments, the changing mat further includes at least one of a shoulder strap and a carrying handle. In some embodiments, the changing mat includes a soil resistant surface.

A changing mat assembly is also disclosed. The changing mat assembly includes a pad, an upper layer, a lower layer, a stiffened portion, a mat-native restraint system, and a mat-foreign restraint system pass-through. The upper layer is disposed on a first side of the pad. The lower layer is disposed opposite the upper layer on a second side of the pad. The stiffened portion is disposed between the upper layer and the lower layer. The mat-native restraint system is coupled to the stiffened portion. The mat-native restraint system is positioned to receive and secure a user to the changing mat assembly. The mat-foreign restraint system pass-through is disposed in the changing mat assembly to facilitate pass-through of a mat-foreign restraint system though the changing mat assembly.

In some embodiments, the changing mat assembly includes a raised portion at an edge of the changing mat.

A changing mat is also disclosed. The changing mat includes a foldable base, a mat-native restraint system, and a pass-through structure. The foldable base includes wing portions, a lower portion, and an upper portion. The wing portions extend outward from opposite sides of the foldable base. The wing portions are foldable towards a center of the foldable base. The lower portion is at a first end of the foldable base. The lower portion includes a storage location and is foldable towards the center of the foldable base. The upper portion is at a second end of the foldable base opposite the first end. The upper portion is foldable towards the center of the foldable base and includes a connecting tab to secure the foldable base in a collapsed state. The mat-native restraint system is coupled to the foldable base. The mat-native restraint system includes a first buckle section and a second buckle section which close to secure a user on the foldable base in a deployed state. The pass-through structure is disposed in the foldable base. The pass-through structure forms a location in the foldable base that is compatible with a mat-foreign restraint system to allow the mat-foreign restraint system to pass through the foldable base and secure the foldable base and the user In some embodiments, the mat-native restraint system includes at least one strap and at least one buckle to secure the user on the changing mat.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are set forth to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
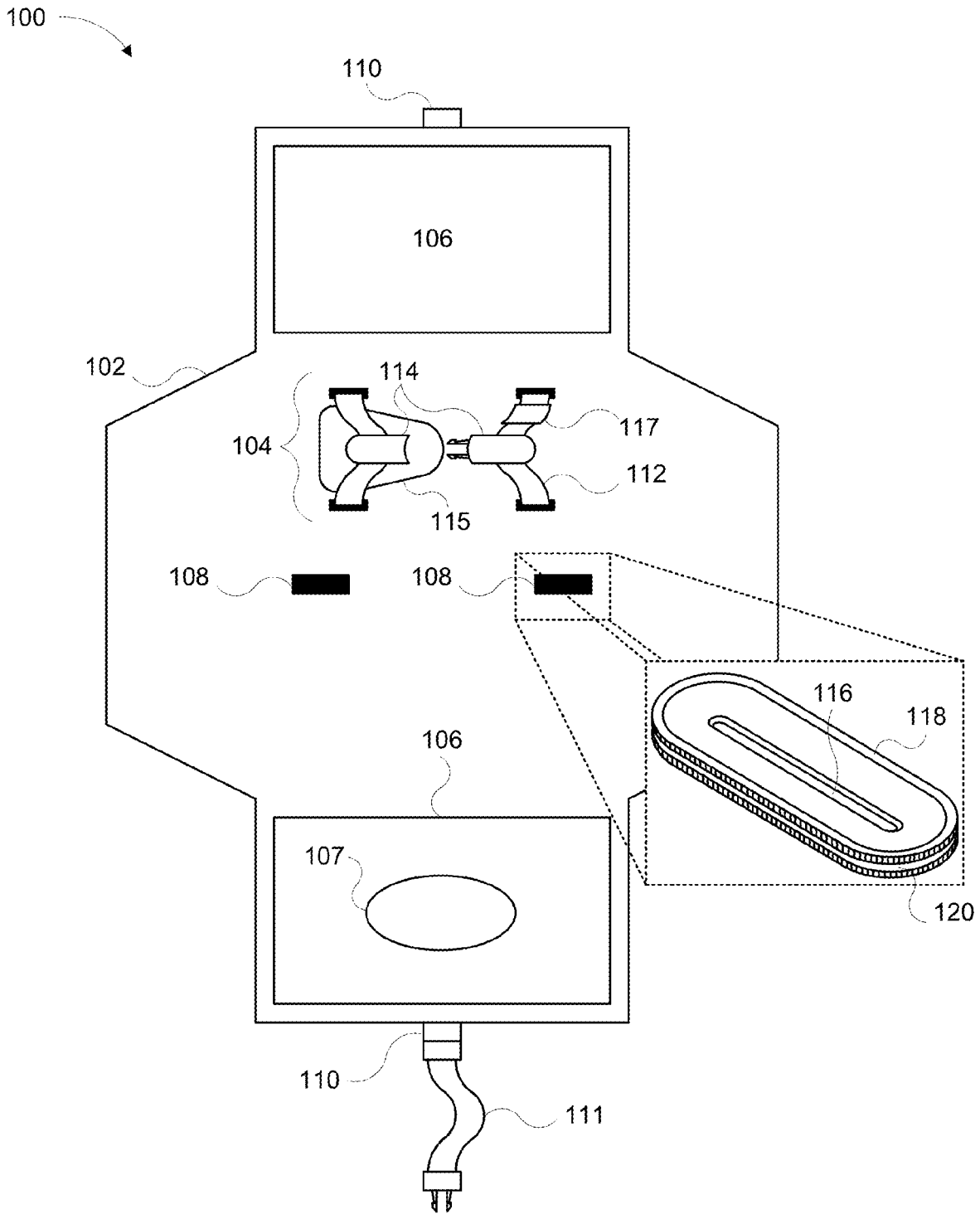
FIG. 1 is a schematic view of a changing mat in accordance with one embodiment of the present invention.

FIG. 1 is a schematic view of a changing mat 100 in accordance with one embodiment of the present invention. In the illustrated embodiment, the changing mat 100 includes a base 102. The base 102 includes a mat-native restraint system 104, storage locations 106, pass-through structures 108, and tabs 110. The base 102, as shown, has a winged geometry to facilitate the arms of a user (such as a child, patient, etc.) while the user is secured in the mat-native restraint system 104 on the mat 100. Other embodiments include other base 102 geometries. In some embodiments, portions of the base 102 can be removed for ease of cleaning, storage, weight reduction, expansion, etc. Some embodiments of the base 102 include materials or surface treatments described in more detail below.

In the illustrated embodiment, the depicted mat-native restraint system 104 is coupled to the base 102. The mat-native restraint system 104, in one embodiment, includes at least one strap 112 and a buckle 114 coupled to the strap 112. In one example, the strap 112 is flexible and may be nylon web, canvas, plastic or other flexible material. In another embodiment, the strap 112 is rigid and may include one or more hinges or other mechanism to lower the strap 112 over the user. In other embodiments, the mat-native restraint system 104 includes a fastener other than a buckle 114, such as a snap, a hook and loop fastener, etc. In one embodiment, the strap 112 is a single piece strap that forms both the left and right sides of the mat-native restraint system 104 while other embodiments of the mat-native restraint system 104 include a plurality of straps 112. In the illustrated embodiment, the mat-native restraint system 104 is configured to secure the shoulders and chest of the user to the changing mat 100. The upper portions of the strap 112 are positioned to pass over each shoulder of the user while the lower portions of the strap 112 are positioned so as to be near the ribcage of the user when in position to be secured. In some embodiments, one or more of the straps 112 includes a pad attached to the strap 112. The pad may be permanently attached or removable. In some embodiments, the pad may have a water repellent coating or other treatment.

The buckle 114 may then be closed over the chest of the user. In some embodiments, the strap 112 of the mat-native restraint system 104 is adjustable. Some embodiments include an adjustment structure near or built into one or both sides of the buckle 114. Other embodiments include an adjustment structure located on the back side of the base 102 (not shown) so as to be out of the way of the user.

The buckle 114 is attached to the strap 112 at a first point and a second point. The buckle 114 is configured to be closeable to join the first point and the second points of the strap 112 and secure the user in place. In some embodiments, the position of the buckle 114 on the strap 112 is adjustable. In some embodiments, one or more straps 112 in combination with a section of the buckle 114 forms a first securing section and another one or more straps 112 in combination with another section of the buckle 114 form a second securing section.

In some embodiments, the buckle 114 includes a shield 115 that is situated between the buckle 114 and a child. The shield 115 may prevent pinching or otherwise improve comfort or safety of the child. The illustrated embodiment also includes a shoulder pad 117. In some embodiments, the shoulder pad 117 increases the comfort of the strap 112 for the user. In some embodiments, the strap 112 and/or the shoulder pad are removeable, for example when a user is trusted to not roll. The buckle 114 is discussed in greater detail below.

The illustrated embodiment of the base 102 also includes storage locations 106. In some embodiments, the storage locations 106 include pouches or pockets to store items associated with the changing mat 100. For examples, the storage locations 106 may be configured to store diapers, wipes, hand sanitizer, pacifiers, clothing, treats, garbage bags, a disposable cover, a storage bag for the changing mat 100, replacement buckle, strap, tabs, etc. In some embodiments, the storage locations 106 are open pockets attached to or formed in the base 102 of the changing mat 100. For example, the storage locations 106 may include an elastic, mesh, or other material attached to the changing mat 100 to facilitate storage of and ready access to diapers, wipes, and other supplies. Some embodiments may include closure systems to close the storage locations 106. Some examples of closure systems include zippers, hook-and-loop, snaps, buttons, sliders, magnets, friction locks, seals, and flaps. In some embodiments, the closures or other openings 107 of the storage locations 106 are reinforced to resist wear or improve an ergonomic quality of the storage locations 106. In some embodiments, the storage locations 106 are open to one or both sides of the changing mat 100. For example, the opening 107 may facilitate access to a storage location 106 while the changing mat 100 is deployed and/or while the changing mat 100 is collapsed in a carry configuration. In some embodiments, the opening 107 is on one or more sides, on a face of the storage location 106, or on a side of the changing mat 100 itself.

The illustrated embodiment of the changing mat 100 also depicts pass-through structures 108 disposed in the base 102. The pass-through structures 108 include at least one through hole 116 made in the pass-through structures 108 to provide access through the base 102. The pass-through structure 108 allows a mat-foreign restraint system (described in greater detail below) to pass through the base 102 of the changing mat 100 and be used to further secure the user to the changing mat 100. In the illustrated embodiment, the pass-through structure 108 includes a through hole 116, an attachment region 118 to facilitate attachment of some embodiments of the pass-through structure 108 to the base 102, and a center channel 120 to engage one or more materials of the base 102. In some embodiments, the pass-through structure 108 is attached to the base 102 via stitching. Adhesives, melt bonding, needling, and other manners of attachment may also be used.

In the illustrated embodiment, two pass-through structures 108 provide two holes in the base 102. In other embodiments, the pass-through structures 108 are a single slot that may be longer than the illustrated embodiment. Other embodiments place the pass-through structures 108 at other locations in the base 102 or have different geometries such as round holes, square holes, oval holes or other geometries, reinforced holes, larger holes, smaller holes, etc. the pass-through structure 108 may include grommets, rivets, snap channels, or other rigid or non-rigid structures. The pass-through structures 108 may be molded into, sewn into, adhered to, bonded with, formed in, pressed into, snapped into, screwed into, punched into, or otherwise removably or fixedly attached to the base 102 of the mat 100 or a structure within the mat 100 as described in greater detail below. In some embodiments, the pass-through structures 108 may include structures to improve durability, reduce friction, provide adjustment functionality, etc.

The illustrated embodiment of the tabs 110 are located at the upper and lower edge of the changing mat 100 and the sides of the changing mat 100. In some embodiments, the tabs 110 are located on the sides, other embodiments on the top and bottom, and other embodiments on the sides, top and bottom. The tabs 110 may include a securing strap 111. Some embodiments may not include the tabs 110. The securing strap 111 is used to secure the changing mat 100 to a changing surface. In some embodiments, the securing strap 111 may wrap around a portion of the changing surface. In some embodiments, the securing strap 111 is a fixed length strap. In other embodiments, the securing strap 111 is an adjustable length strap.

In another embodiment, the tabs 110 may be secured to a surface of the changing surface. In some embodiments, the tabs 110 may interface with a securing element of the changing surface. The tabs 110 may be configured for removable coupling to the changing surface or permanent installation. Examples of some securing elements may include clips, hooks, snaps, posts, loops, hook-and-loop, and clamps. Other securing elements may also be incorporated.

Figure 2:
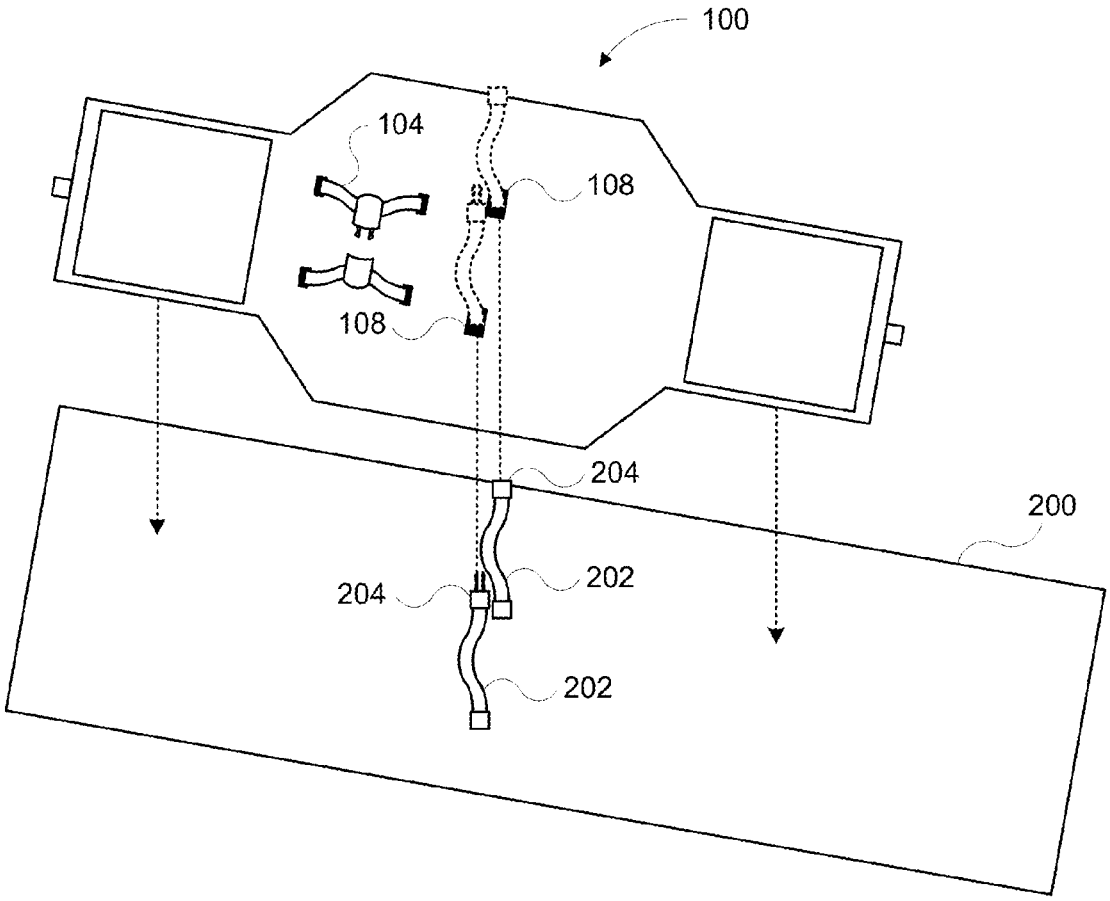
FIG. 2 is a perspective view of the changing mat of FIG. 1 with a changing surface in accordance with one embodiment of the present invention.

FIG. 2 is a perspective view of the changing mat 100 of FIG. 1 with a changing surface 200 in accordance with one embodiment of the present invention. In the illustrated embodiment, the changing surface 200 includes a mat-foreign restraint system 202. In one embodiment, the mat foreign restraint system 202 is a strap coupled to the changing surface. The strap may be nylon web, canvas, plastic or other material. In other embodiments, the mat-foreign restraint system 202 may be a rope or other element. Because the mat-foreign restraint system is coupled to the changing surface 200, the mat-foreign restraint system 202 is native to the changing surface 200 and foreign to the changing mat 100.

The mat-foreign restraint system 202, as depicted, includes a buckle 204 to connect the mat-foreign restraint system 202 around the waist of a child placed on the changing surface 200. In the illustrated embodiment, the pass-through structures 108 of the changing mat 100 allow the mat-foreign restraint system 202 to pass through the changing mat 100. In this manner, the changing mat 100 may be placed on the changing surface 200 to provide a sanitary and easy to clean surface without complicating or rendering useless the use of the mat-foreign restraint system 202. The mat-foreign restraint system 202 can pass through the changing mat 100 at the pass-through structures 108 to be secured around the child on the changing mat 100 to supplement the mat-native restraint system 104 to secure the child.

In this manner, the child may be secured relative to the changing mat 100 and to the changing surface 200. With both the mat-native restraint system 104 and the mat-foreign restraint system 202 of the changing mat 100 and the changing surface 200 the risk of a child falling off of a changing surface 200 or squirming to complicate a changing operation is reduced. The embodiments described herein may be used on changing surfaces 200 such as a home changing table or public changing tray.

Figure 3:
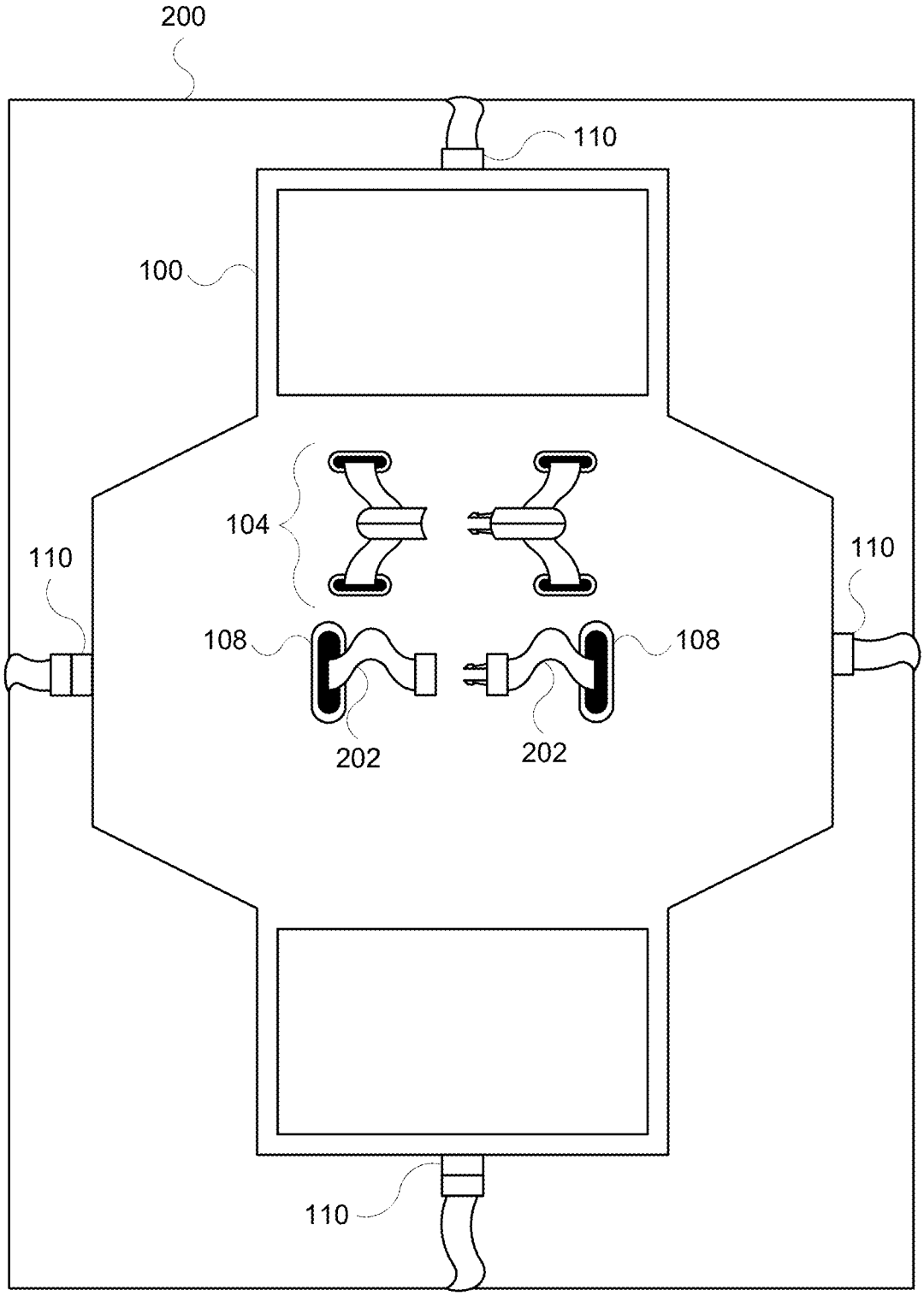
FIG. 3 is a schematic view of the changing mat and changing surface of FIG. 2 in accordance with one embodiment of the present invention.

FIG. 3 is a schematic view of the changing mat 100 and changing surface 200 of FIG. 2 in accordance with one embodiment of the present invention. In the illustrated embodiment, the changing mat 100 is secured to the changing surface 200 via the tabs 110. Further, the mat-foreign restraint system 202 is passed through the pass-through structures 108 of the changing mat 100. In the depicted embodiment, it can be seen how the use of the mat-native restraint system 104 and the mat-foreign restraint system 202 synergizes to secure a child simultaneously to the changing mat 100 and the changing surface 200. In the illustrated embodiment, the mat-native restraint system 104 and the mat-foreign restraint system 202 are separately coupled to secure the child. In further embodiments, described below, the two restraint systems 104 and 202 may be coupled to further enhance the security of the child.

Figure 4A:
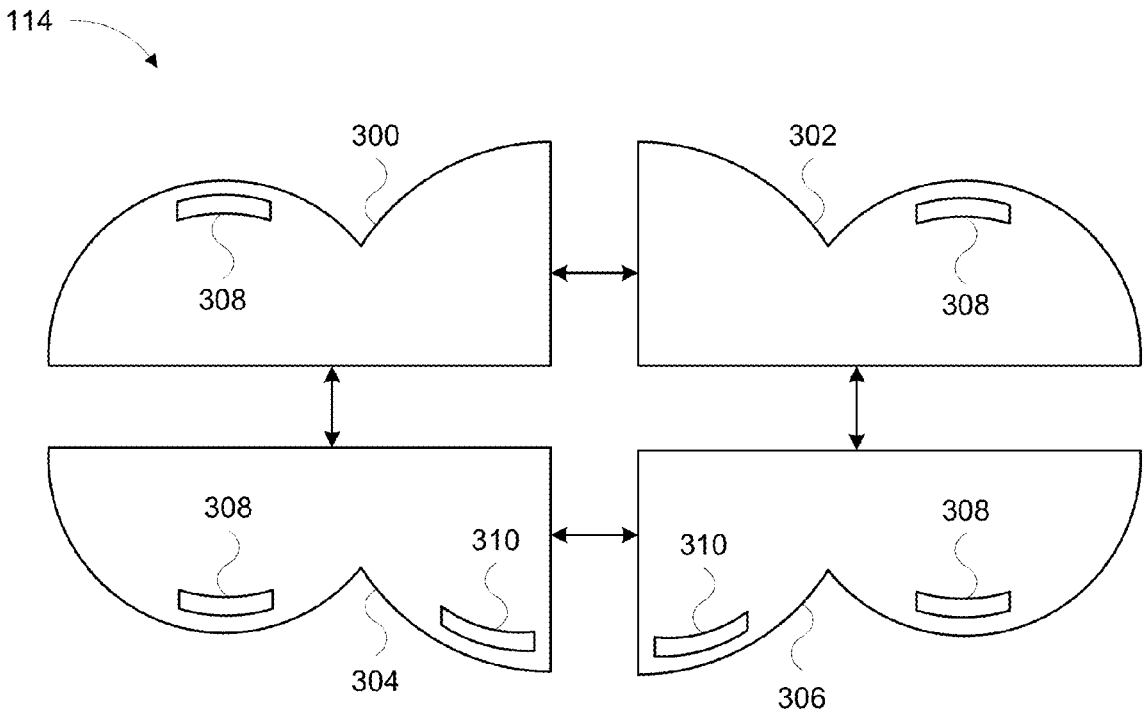
FIGS. 4A-D are schematic views of buckles for a changing mat restraint system in accordance with various embodiments of the present invention.

FIGS. 4A-D are schematic views of buckles 114 for a changing mat restraint system in accordance with embodiments of the present invention. In FIG. 4A, one embodiment of the buckle 114 is shown. In this embodiment, the buckle 114 includes four separate sections, including a first section 300, and second section 302, a third section 304, and a fourth section 306. The separate sections 300-306 are interconnectable. For example, the first section 300 connects to the second section 302 and the third section 304. While a specific connecting structure to connect the sections 300-306 is not illustrated, any one or more of a variety of connecting structures may be used to connection the section 300-306. For example, the sections 300-306 may include clips, inserts, receivers, loops, ties, magnets, post-and-hole, hooks, twist locks, latches, and buttons. Other mechanisms or structures may also be used.

In the illustrated embodiment, each of the sections 300-306 includes a mat connecting point 308. The connecting points 308 are configured to receive the straps of the mat-native restraint system 104. The third and fourth section 304 and 306 also include surface connecting points 310. The surface connecting points 310 facilitate connection of the mat-foreign restraint system 202 to the buckle 114. Connection of the mat-foreign restraint system 202 to the buckle 114 is described in greater detail below. The connecting points 308 and 310 are shown as slots. In other embodiments, the connecting points 308 and 310 may be snaps, clips, friction locks, or sliders.

Figure 4B:
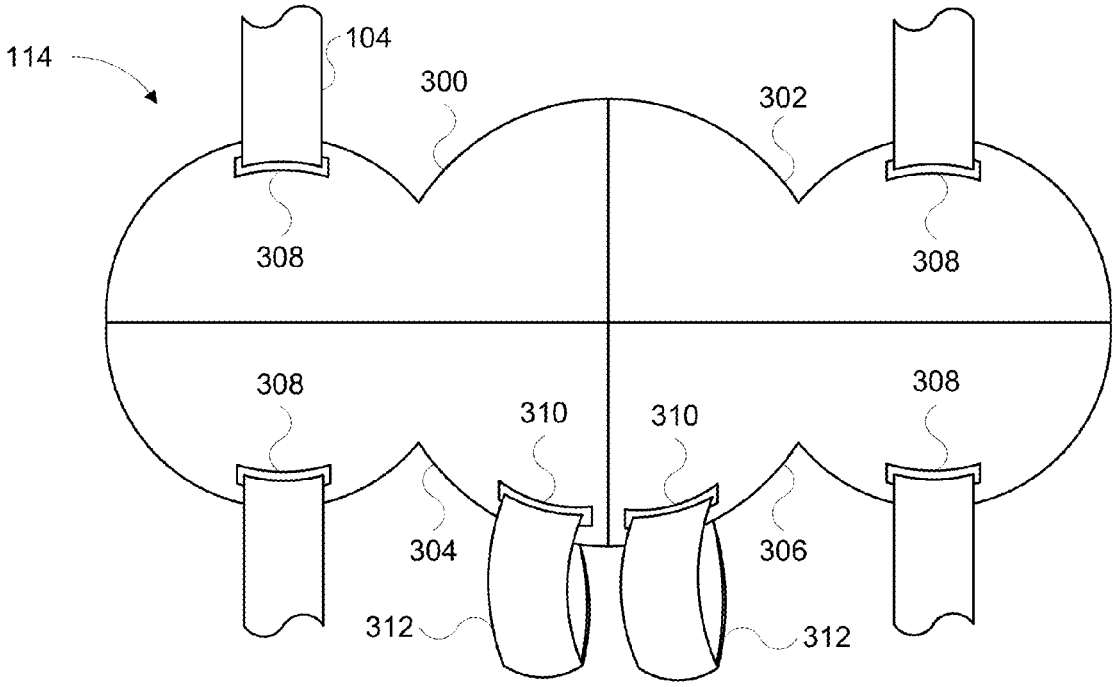

FIG. 4B depicts another embodiment of the buckle 114. In this embodiment, the buckle 114 is closed. The illustrated embodiment of the buckle 114 includes the straps of the mat-native restraint system 104. In the illustrated embodiment, the mat-native restraint system 104 couples to the buckle 114 by feeding through the connecting points 308. The mat-native restraint system 104 may be fixed or adjustable relative to the buckle 114.

The illustrated embodiment of the buckle 114 also includes a pair of attachment structures 312 coupled to the buckle 114 at the surface connecting points 310. The attachment structures 312 are coupled to the buckle 114 and provide a location for the mat-foreign restraint system 202 to attach to the buckle 114. In some embodiments, the attachment structures 312 are strap loops though which the mat-foreign restraint system 202 may be fed. The attachment structure 312 may be fixed with respect to the buckle 114 or removable. For example, the attachment structures 312 may be hooks, openable loops, clips, snaps, or other structures to couple the mat-foreign restraint system 202 to the buckle 114.

Figure 4C:
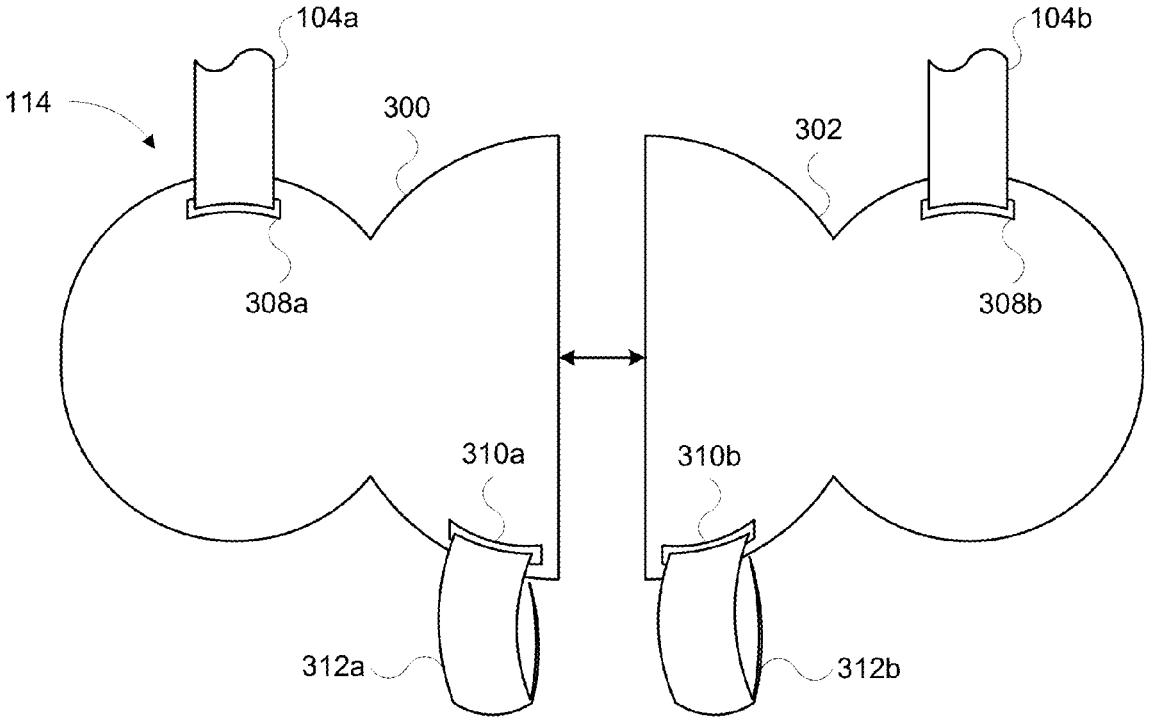

FIG. 4C depicts another embodiment of the buckle 114. In the illustrated embodiment, the buckle 114 includes only a first section 300 and a second section 302. In this embodiment, the first section 300 includes a first shoulder connecting point 308*a* to couple a first shoulder strap 104*a* to the buckle 114. The first section 300 also includes a first mat-foreign restraint system connection point 310*a* to accommodate a first attachment structure 312*a*. The second section 302 is similar to the first with similar numbers for similar components. In this embodiment, no ribcage straps are present in the mat-native restraint system 104. Alternatively, the ribcage straps may be coupled to the first and second shoulder connecting points 308*a-b* along with the first and second should straps 104*a-b*. Other embodiments provide for other strap and connection point arrangements.

Figure 4D:
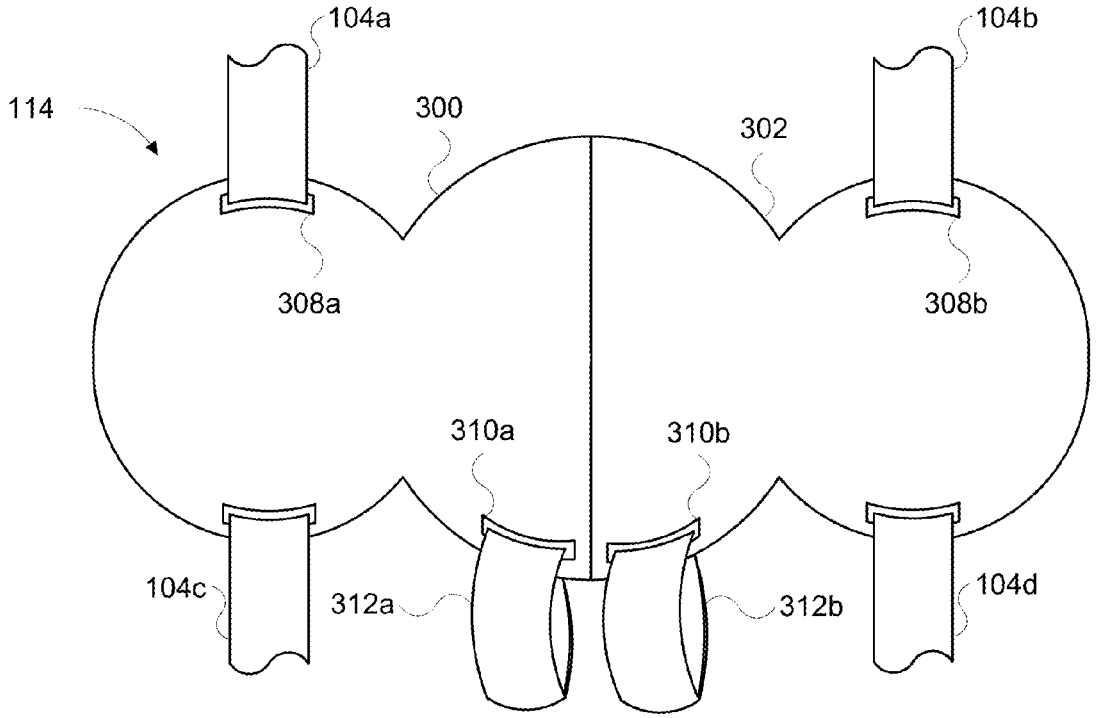

FIG. 4D depicts another embodiment of the buckle 114. In the illustrated embodiment, the first and second sections 300 and 302 of the buckle 114 are coupled. In this embodiment, the buckle 114 is similar to the embodiment described in FIG. 4B with the exception being that the third and fourth sections 304 and 306 of the buckle 114 of FIG. 4B are unified into the first and second sections 300 and 302. Other embodiments include other buckles (not shown) with various methods of securing the user to the changing mat 100.

Figure 5A:
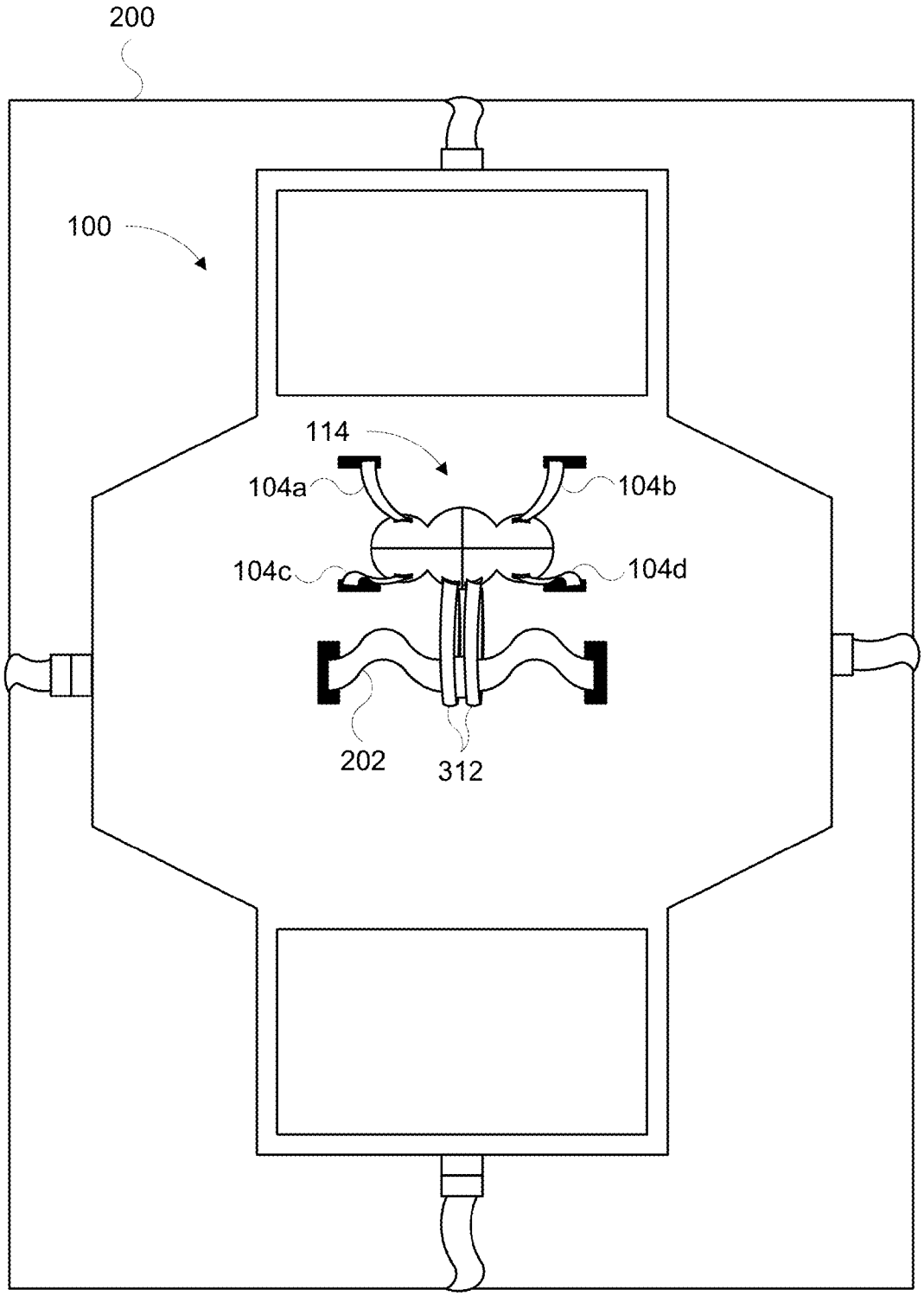
FIG. 5A is a schematic view of a changing mat with the buckle of FIGS. 4A-B in accordance with one embodiment of the present invention.

FIG. 5A is a schematic view of a changing mat 100 with the buckle 114 of FIGS. 4A-B in accordance with one embodiment of the present invention. In the illustrated embodiment, the buckle 114 is attached to the first and second shoulder straps 104*a-b* as well as the first and second ribcage straps 104*c-d*. The buckle 114 also includes the attachment structures 312 which are coupled to the mat-foreign restraint system 202 of the changing surface 200. The buckle 114 secures the user to the changing mat 100 by coupling the mat-native restraint system 104 to the mat-foreign restraint system 202.

Figure 5B:
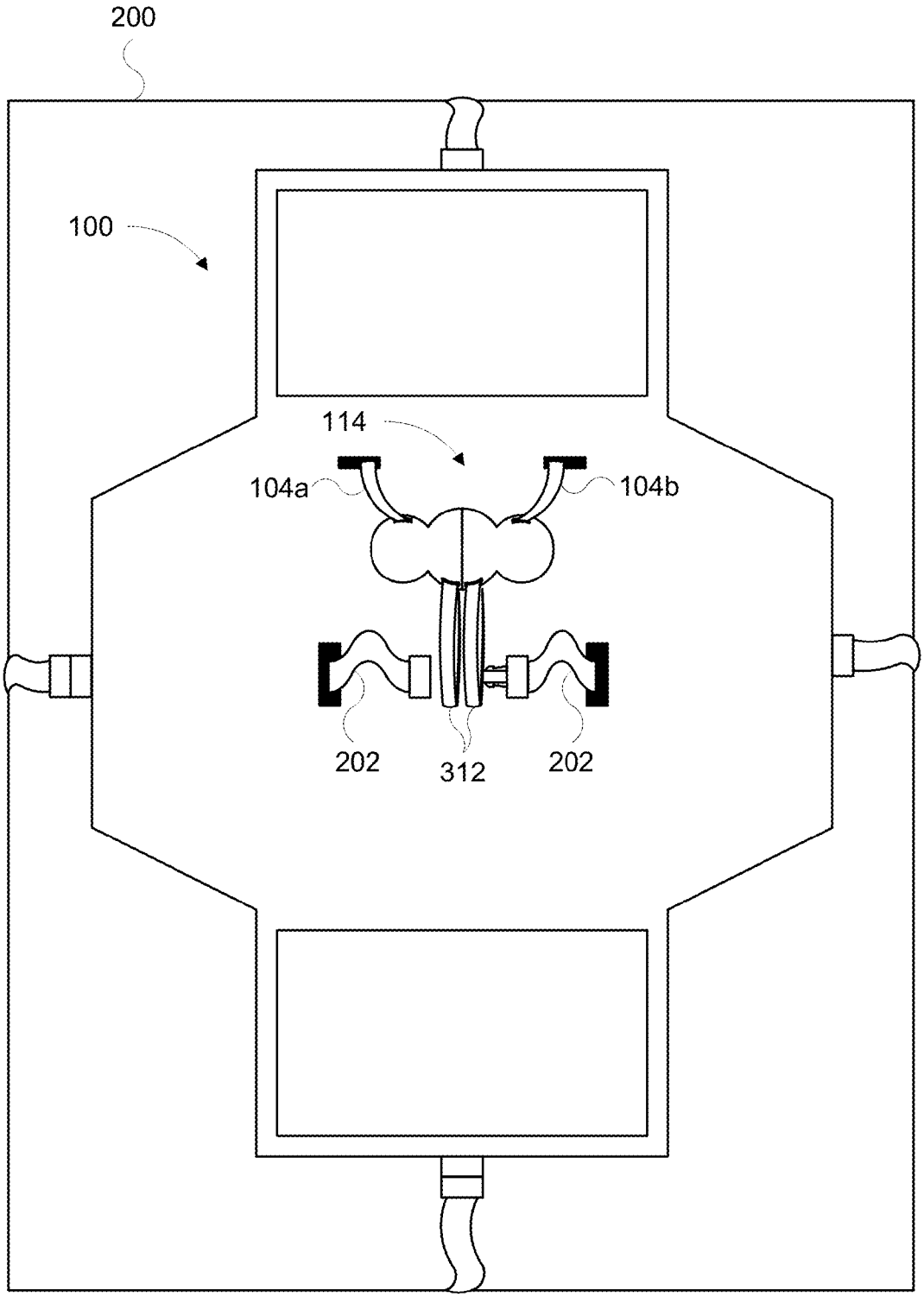
FIG. 5B is a schematic view of a changing mat with the buckle of FIG. 4C in accordance with one embodiment of the present invention.

FIG. 5B is a schematic view of a changing mat 100 with the buckle 114 of FIG. 4C in accordance with one embodiment of the present invention. In the illustrated embodiment, the buckle 114 is coupled to the first and second shoulder straps 104*a-b* and, via the attachment structure 312, to the mat-foreign restraint system 202 of the changing surface 200. In the illustrated arrangement, the changing mat 100 relies on the first and second mat-native restraint system shoulder straps 104*a-b* in connection with the mat-foreign restraint system 202 via the attachment structure 312 of the buckle 114. With the connection of the two restraint systems 104 and 202, a child or user may be secured. While the buckle 114 is shown as having two separate sections, other embodiments may implement a buckle with a single unified piece. In this embodiment, the buckle 114 with the attached straps 104*a-b* may be pulled over the user's head and the mat-foreign restraint system 202 closed through the attachment structure 312 to secure the user. Other embodiments may utilize fewer or more components to achieve more or less functionality.

Figure 6A:
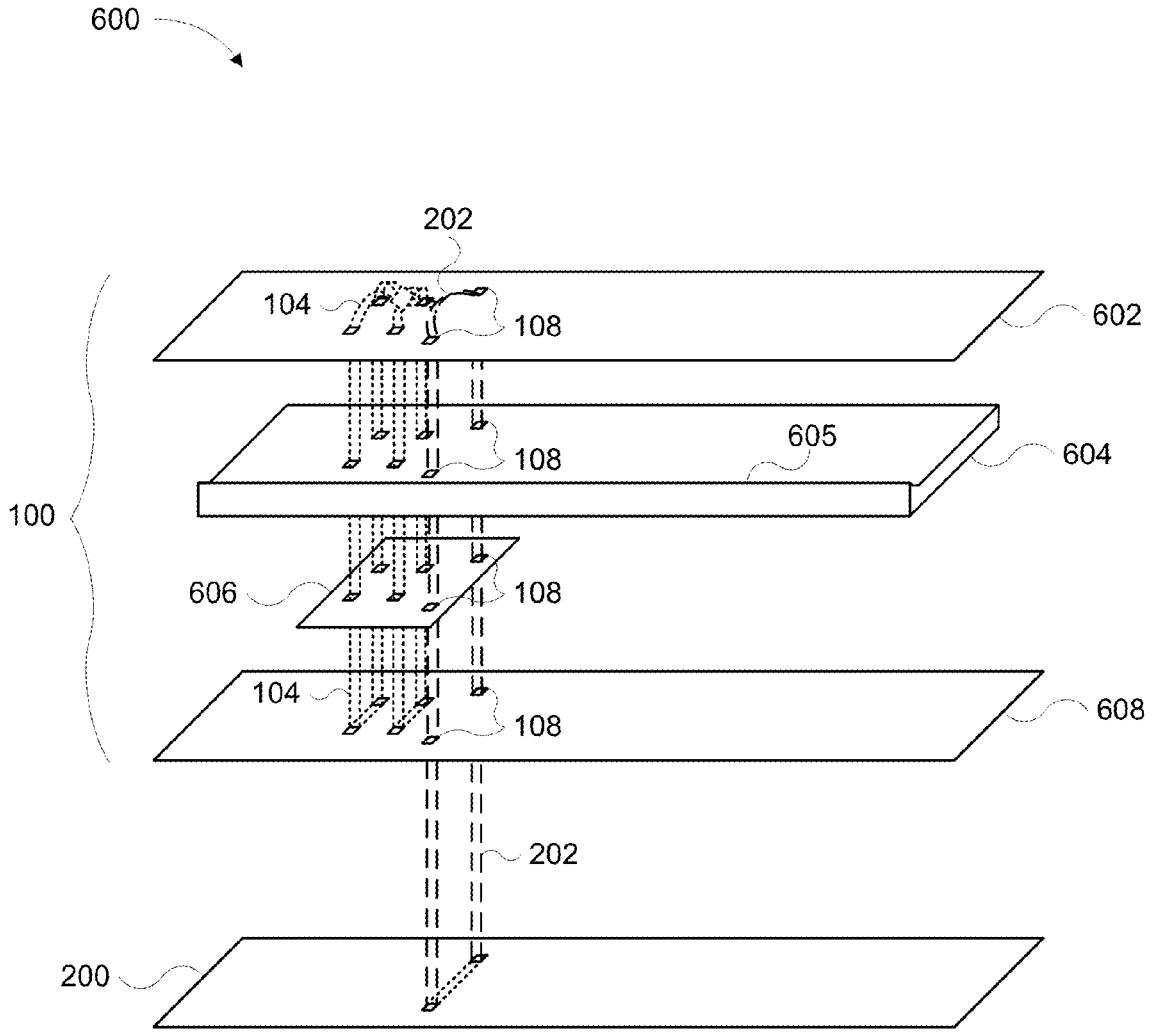
FIG. 6A is an exploded view of an assembly of a changing mat in accordance with one embodiment of the present invention.

FIG. 6A is an exploded view of an assembly 600 of a changing mat 100 in accordance with one embodiment of the present invention. The illustrated embodiment of the changing may 100 includes an upper layer 602. The upper layer 602 includes pass-through structures 108 to allow the mat-foreign restraint system 202 to pass through the upper layer 602. In some embodiment, the upper layer 602 also facilitates pass-through of the mat-native restraint system 104. In some embodiments, the upper layer 602 is coupled to the mat-native restraint system 104. In some embodiments, the upper layer 602 includes a removable sheet or other soft-touch material. In some embodiments, the upper layer 602 is soil-resistant or includes a soil-resistant treatment. For example, the upper layer 602 may be waterproof, hydrophobic, easy clean, etc.

In some embodiments, the upper layer 602 is coupled to a pad 604. The illustrated embodiment of the pad 604 includes pass-through structures 108 as described above and a raised section 605 at an edge of the pad 605. The raised section 605 may retain spills or further secure the user on the changing mat 100. While the raised section 605 is shown as formed by the pad 604, other embodiments form the raised section 605 in some or all of the other layers described herein. In some embodiments, the pad 604 is a foam pad. In one embodiment, the foam pad is an open cell poly-ethylene foam. Other embodiments may include other foams, gel, air cells, liquid, spring, batting, fabric or other elements to form the pad 604. The pad 604 may be adhered or bonded to the upper layer 602. Alternatively, the pad 604 may be uncoupled from the upper layer 602.

In some embodiments, the pad 604 is removable relative to the rest of the changing mat 100. In one embodiment, the upper layer 602 and lower layer 608 include a zipper, seal, or other closure mechanism to removably secure the pad 604 between the upper layer 602 and the lower layer 608.

In the illustrated embodiment of the assembly 600, the changing mat 100 also includes a stiffened portion 606. The stiffened portion 606 provides a rolling resistance component to prevent a user from rolling the changing mat once the user is secured to the changing mat 100. The stiffened portion 606 includes a material with a stiffness that is higher than a stiffness of the other components of the changing mat 100. In one embodiment, the stiffened portion 606 is a plastic sheet. The stiffened portion 606 may also include a wood, composite, metal, or other material. In one embodiment, the stiffened portion 606 includes holes for the straps 112 and for straps of the mat-foreign restraint system 202. In another embodiment, the stiffened portion 606 includes holes for the straps 112, but may be shortened and may not include holes for straps of the mat-foreign restraint system 202.

The changing mat 100 of the assembly 600 also includes a lower layer 608. In the illustrated embodiment, the lower layer 608 is a termination point for the mat-native restraint system 104. In other embodiments, the mat-native restraint system 104 may be terminated at another layer or component of the changing mat 100. For example, the mat-native restraint system 104 could terminate at the stiffened portion 606 without reaching to the lower layer 608. In some embodiments, the lower layer 608 is similar to the upper layer 602 in material and function. In other embodiments, the lower layer 608 is different from the upper layer 602. For example, the lower layer 608 may include a no slip surface to reduce slipping of the changing mat 100 relative to the changing surface 200. The lower surface 608 may also include a biocidal or other sanitizing or clean surface.

In one embodiment, the changing mat 100 includes a removable cover (not shown). The removable cover, in one embodiment, includes holes for the straps 112 and straps of the mat-foreign restraint system 202. In some embodiments, the holes in the cover may be reinforced to resist tearing around the holes as the cover moves. The removable cover and straps 112, in one embodiment, are removable and washable.

The assemble 600 also includes a changing surface 200. The changing surface 200 includes a mat-foreign restraint system 202. In the illustrated assembly 600, the mat-foreign restraint system 202 is fed through the pass-through structure 108 of the various layers 602-608 of the changing mat 100 to be used to supplement the mat-native restraint system 104 at the upper layer 602.

Figure 6B:
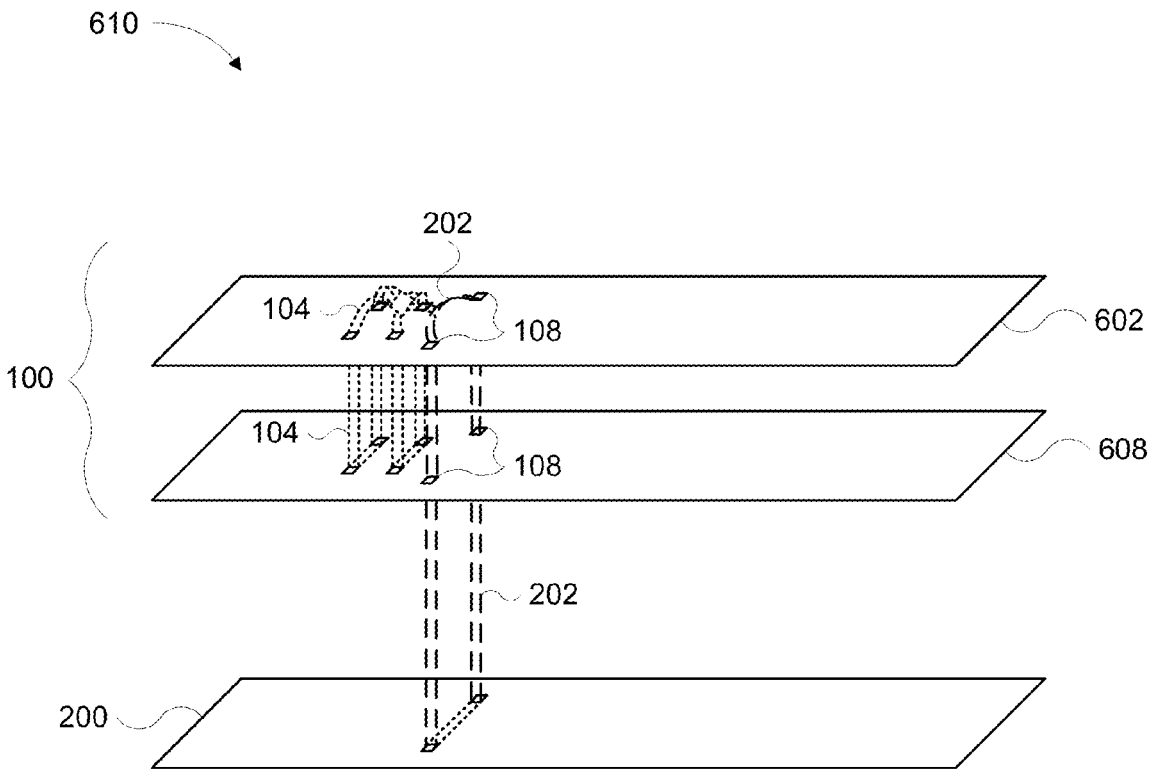
FIG. 6B is an exploded view of another assembly of a changing mat in accordance with one embodiment of the present invention.

FIG. 6B is an exploded view of another assembly 610 of a changing mat 100 in accordance with one embodiment of the present invention. The illustrated embodiment is similar to the assembly 600 of FIG. 6A. However, in this embodiment, the assembly 610 removes the stiffened portion 606 of the assembly 600 of FIG. 6A. Additionally, the changing mat 100 omits the pad 604. This may increase portability and reduce the amount of space needed to store the changing mat 100. Other embodiments may include other combinations of the components described above.

Figure 7:
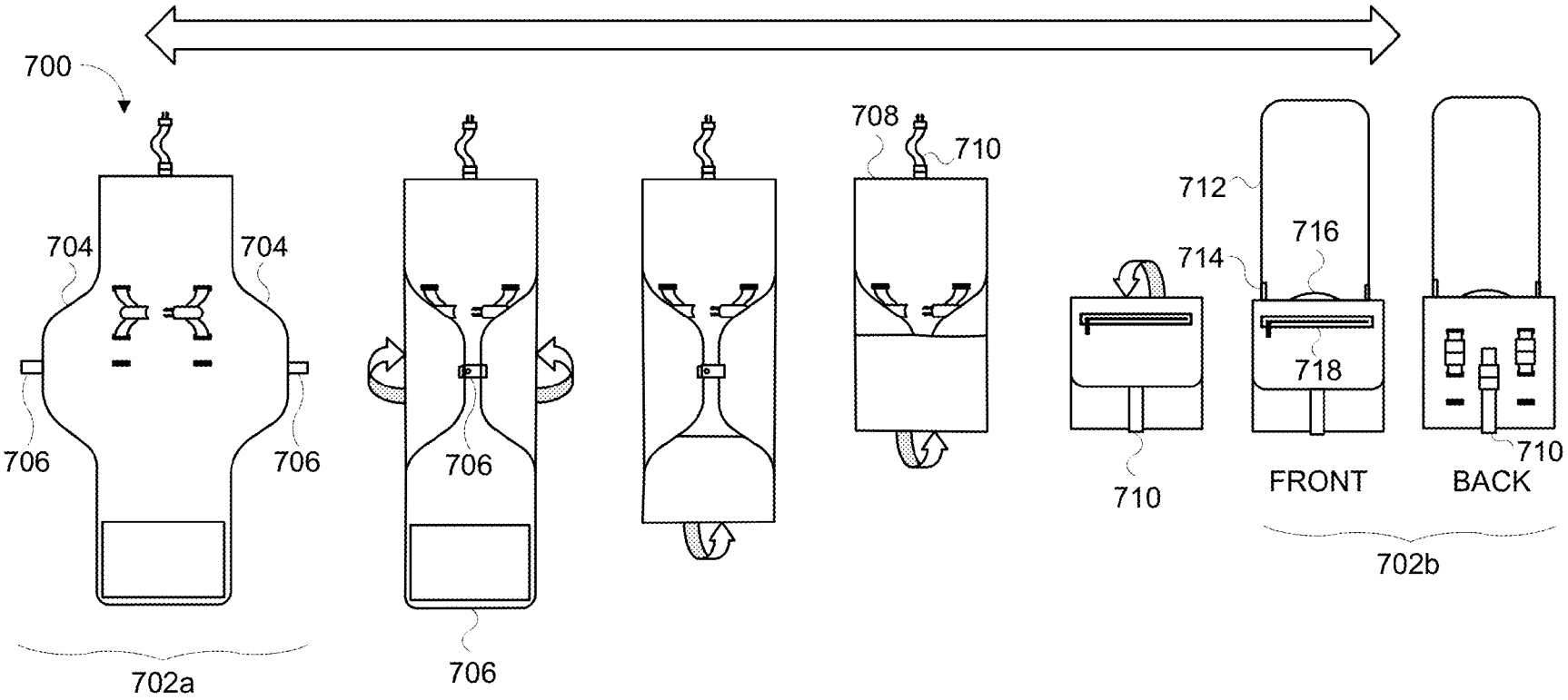
FIG. 7 is a transitional view of a collapsing mechanic of a changing mat in accordance with one embodiment of the present invention.

FIG. 7 is a transitional view of a collapsing mechanic of a changing mat 700 in accordance with one embodiment of the present invention. In the illustrated embodiment, the changing mat 700 is shown in stages between a deployed state 702*a* and a collapsed state 702*b*. For clarity, the following description relates to a transition from the deployed state 702*a* to the collapsed state 702*b* (shown in both a front view and a back view).

In the illustrated embodiment, the changing mat 700 includes wing portions 704 with tabs 706 corresponding with and coupled to an outside edge of each wing portions 704. In the illustrated embodiment, the wing portions 704 are folded inward and the tabs 706 are coupled to one another to secure the wing portions 704 in the folded position. In the illustrated embodiment, the changing mat 700 also includes a lower portion 707.

In the illustrated embodiment, the lower portion 707 is folded toward the center of the changing mat 700, tucking corners under the folded wing portions 704 to secure the lower portion 707. The lower portion 707 is then folded once more towards the center of the changing mat 700.

In the illustrated embodiment, the changing mat 700 includes an upper portion 708 to which a strap or connecting tab 710 is coupled. The upper portion 708 is shown to fold toward the center of the changing mat 700 with the connecting tab 710 wrapping around the folded lower portion 707 to a backside of the changing mat 700 to secure the changing mat 700 in the collapsed state 702*b*.

In the illustrated embodiment, the changing mat 700 includes a shoulder strap 712 coupled to the changing mat 700 via one or more connecting structures 714. The illustrated embodiment also includes a carrying handle 716 situated at fold of the upper portion 708 of the changing mat 700. In some embodiments, one or more of the shoulder strap 712 and the carrying handle 716 are adjustable and/or removeable.

The illustrated embodiment of the changing mat 700 also includes a pocket access 718 disposed on the upper portion 708. The pocket access 718 may provide access to a storage location within the changing mat 700. In some embodiments, the pocket access 718 provides access to a storage location that is mutually accessible from both sides of the changing mat 700. In other embodiments, the pocket access 718 provides sole access to a storage location. In some embodiments, the pocket access 718 provides a stowing location for one or more of the shoulder strap 712 and the carrying handle 716.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a changing mat;

a mat-native restraint system coupled to the changing mat at a location on the changing mat to correspond to shoulders of a user to receive and secure the user on the changing mat; and a pass-through structure disposed in the changing mat, wherein a pass-through structure is located on either side of a waist of the user at a position separate from the location of the mat-native restraint system, wherein the pass-through structure is positioned to accommodate pass-through, at the changing mat, of at least a portion of a mat-foreign restraint system to secure the changing mat to a changing surface and to further secure the user on the changing mat supplementary to the mat-native restraint system.

2. The apparatus of claim 1, wherein the mat-native restraint system comprises at least one strap to secure at least one of a chest and the shoulders of the user on the changing mat.

3. The apparatus of claim 2, wherein the at least one strap includes at least one pad disposed on the at least one strap.

4. The apparatus of claim 2, wherein the mat-native restraint system further comprises a buckle separately coupled to at least a first point and a second point of the at least one strap, wherein connecting the first point and the second point via the buckle secures the user to the changing mat.

5. The apparatus of claim 4, wherein the buckle is divided into at least four interconnecting buckle sections comprising a first buckle section coupled to a first shoulder portion of the at least one strap, a second buckle section coupled to a second shoulder portion of the at least one strap, a third buckle section coupled to a first ribcage portion of the at least one strap, and a fourth buckle section coupled to a second ribcage portion of the at least one strap.

6. The apparatus of claim 4, wherein the buckle comprises an attachment structure to interface with the mat-foreign restraint system.

7. The apparatus of claim 4, wherein the buckle comprises at least one of a clip, a snap, a hook-and-loop, a cinch, and a tie.

8. The apparatus of claim 4, further comprising a shield positioned between the buckle and the user.

9. The apparatus of claim 1, wherein the pass-through structure comprises at least one slot in the changing mat to allow at least a portion of the mat-foreign restraint system to pass through the changing mat.

10. The apparatus of claim 1, wherein the mat-foreign restraint system comprises at least one strap coupled to the changing surface.

11. The apparatus of claim 1, wherein the changing surface is a changing surface of a fixed location changing table.

12. The apparatus of claim 1, wherein the changing mat comprises a stiffened portion to resist a bending of the changing mat in at least one dimension.

13. The apparatus of claim 1, wherein the changing mat comprises at least one tab on an edge of the changing mat to secure the edge of the changing mat relative to the changing surface.

14. The apparatus of claim 1, wherein the changing mat is at least one of foldable, collapsible, rollable, and stuffable.

15. The apparatus of claim 14, wherein the changing mat further comprises at least one of a shoulder strap and a carrying handle.

16. The apparatus of claim 1, wherein the changing mat comprises a soil resistant surface.

17. A changing mat assembly comprising:

a pad;

an upper layer disposed on a first side of the pad;

a lower layer disposed opposite the upper layer on a second side of the pad;

a stiffened portion disposed between the upper layer and the lower layer;

a mat-native restraint system coupled to the stiffened portion at a location to correspond to shoulders of a user, the mat-native restraint system positioned to receive and secure the user to the changing mat assembly; and a mat-foreign restraint system pass-through disposed in the changing mat assembly, wherein a mat-foreign restraint system is located on either side of a waist of the user at a position separate from the location of the mat-native restraint system, wherein the mat-foreign restraint system is positioned to facilitate pass-through of a mat-foreign restraint system through the changing mat assembly to further secure the user on the changing mat supplementary to the mat-native restraint system.

18. The changing mat assembly of claim 17, wherein the changing mat assembly comprises a raised portion at an edge of the changing mat assembly.

19. A changing mat comprising:

a foldable base comprising:

wing portions extending outward from opposite sides of the foldable base, the wing portions foldable towards a center of the foldable base;

a lower portion at a first end of the foldable base, the lower portion comprising a storage location and being foldable towards the center of the foldable base; and an upper portion at a second end of the foldable base opposite the first end, the upper portion being foldable towards the center of the foldable base and comprising a connecting tab to secure the foldable base in a collapsed state;

a mat-native restraint system coupled to the foldable base at a location to correspond to shoulders of a user, the mat-native restraint system comprising a first securing portion and a second securing portion which close to secure the user on the foldable base in a deployed state; and a pass-through structure, disposed in the foldable base, forming a location in the foldable base on either side of a waist of the user at a position separate from the location of the mat-native restraint system, wherein the pass-through structure is compatible with a mat-foreign restraint system, to allow the mat-foreign restraint system to pass through the foldable base and secure the foldable base and the user supplementary to the mat-native restraint system.

20. The changing mat of claim 19, wherein the mat-native restraint system comprises at least one strap and at least one buckle to secure the user on the changing mat.

* * * * *